US005762524A

United States Patent [19]

Ford et al.

[11] Patent Number: 5,762,524

[45] Date of Patent: Jun. 9, 1998

[54] WATERPROOF STRUCTURE OF SOLDERLESS CONNECTOR

[75] Inventors: Rhodri Ford, Hertfordshire, England; Haruki Yoshida, Shizuoka-ken, Japan; Motohisa Kashiyama, Shizuoka-ken, Japan; Masanori Tsuji, Shizuoka-ken, Japan; Takayoshi Endo, Shizuoka-ken, Japan

[73] Assignee: Yazaki Corporation, Tokyo, Japan

[21] Appl. No.: 710,928

[22] Filed: Sep. 24, 1996

[30] Foreign Application Priority Data

Sep. 25, 1995 [JP] Japan ..... 7-246126

[51] Int. Cl.[6] ..... H01R 13/40

[52] U.S. Cl. ..... 439/589

[58] Field of Search ..... 439/588, 589

[56] References Cited

U.S. PATENT DOCUMENTS

| | | | |
|---|---|---|---|
| 3,125,395 | 3/1964 | Swanson | 439/660 |
| 4,690,478 | 9/1987 | Rahrig et al. | 439/587 |
| 5,593,321 | 1/1997 | Hotea | 439/589 |

FOREIGN PATENT DOCUMENTS 4-49480 4/1992 Japan .

*Primary Examiner*—P. Austin Bradley
*Assistant Examiner*—T. C. Patel
*Attorney, Agent, or Firm*—Finnegan, Henderson, Farabow, Garrett & Dunner, L.L.P.

[57] ABSTRACT

A case having a case body, in which a plurality of terminal accommodating chambers are formed in parallel, and an elastic waterproof portion, which is formed integrally with the case body and which has a plurality of wire insertion holes into which covered wires are inserted in a waterproof state is inserted through an opened portion of a connector housing so that the elastic waterproof portion is fitted to the opened portion in a waterproof state. Therefore, when the covered wires are inserted into the wire insertion holes, the projecting portions of the covered wires simply are required to be adjusted to have a predetermined length. Thus, the necessity of furthermore adjusting the projection portion when the solderless connection is established can be eliminated. Since the elastic waterproof portion is formed integrally with the case body, pressure cannot easily act on the portions in which the solderless terminals and the covered wires are solderless-connected to one another even if the elastic waterproof portion is strongly pressed to the inside of the opened portion. Therefore, the electrically conductive state between the solderless terminals and the covered wires can be maintained.

5 Claims, 8 Drawing Sheets

WATERPROOF STRUCTURE OF SOLDERLESS CONNECTOR

BACKGROUND OF THE INVENTION

Field of the Invention

The present invention relates to a waterproof structure of a solderless connector for use to connect, for example, a wire harness.

Description of the related Art

A conventional waterproof structure of a solderless connector of the foregoing type has been disclosed in Japanese Patent Laid-Open No. 4-49480.

The solderless connector includes a connector case accommodating solderless terminals in parallel, one collective rubber plug formed into a plate-like shape and having wire sealing holes formed in parallel and a connector cover to be mounted on the connector case. Covered wires, to be connected to the solderless terminals, are individually inserted into the wire sealing holes of the collective rubber plug so that the covered wires are solderless-sealed. The solderless connectors solderless-connected to the covered wires are accommodated in a box-shape accommodation case having one opened surface and the other closed surfaces in such a manner that the outer surface of the collective rubber plug is hermetically fitted to the periphery of the opened portion of the accommodation case.

In the above-mentioned structure, a main portion of the connector including the portions, in which the solderless terminals and the covered wires are solderless-connected to one another, is accommodated in the accommodation case having one opened surface. Moreover, the opened portion of the accommodation case is waterproofed by the collective rubber plug. As a result, the main portion of the connector can satisfactorily be waterproofed.

The above-mentioned waterproof structure is needed to insert the covered wires into the wire sealing holes of the collective rubber plug in such a manner that adjustment is performed to cause the covered wires to project by the same length. Moreover, when the covered wires are solderless-connected to the solderless terminals, the covered wires and the solderless terminals must be located to be adaptable to the depth of the accommodation case.

After the covered wires have been solderless-connected to the solderless terminals, a state is realized in which the collective rubber plug is supported by the accommodation case through the covered wires. Since the collective rubber plug in the foregoing state is fitted to the opened portion of the accommodation case, the portions in which the solderless terminals and the covered wires are solderless-connected to one another are loaded when the collective rubber plug is applied with pressure. Thus, there arises a risk that the state of electrical conduction among the solderless terminals and the covered wires is made defective. Therefore, the operation for fitting the collective rubber plug must be performed carefully.

As a result, the operation for assembling the solderless connector becomes too complicated, thus resulting in the productivity being allowed to deteriorate. Moreover, the cost cannot be reduced.

SUMMARY OF THE INVENTION

In view of the foregoing, an object of the present invention is to provide a waterproof structure of a solderless connector which can easily be assembled and with which the productivity can be improved and the cost can be reduced.

According to an aspect as claimed in claim 1 of the present invention, there is provided a waterproof structure of a solderless connector comprising: a case having a case body including a plurality of terminal accommodating chambers which accommodate a plurality of solderless terminals, to which covered wires are solderless-connected, and which are formed in parallel; and an elastic waterproof portion formed integrally with an end of the case body and having a plurality of wire insertion holes through which the covered wires are inserted in a waterproof state, the wire insertion holes being formed at an end adjacent to the terminal accommodating chambers, wherein another end of the case is inserted through an opened portion of a connector housing so that the case body is accommodated in the connector housing, and the periphery of the elastic waterproof portion is fitted to the opened portion of the connector housing in a waterproof state.

According to the aspect of the present invention as claimed in claim 1, a solderless connector is assembled such that the solderless terminals are accommodated in the terminal accommodating chambers of the case body. Then, the covered wires are inserted into the wire insertion holes of the elastic waterproof portion. Thus, the covered wires are inserted into the wire insertion holes in a waterproof state.

Then, the inserted covered wires are pushed so as to be solderless-connected to the solderless terminals, and then another end of the case is inserted into the opened portion of the connector housing so that the case body is accommodated in the connector housing. Moreover, the periphery of the elastic waterproof portion is fitted to the opened portion in a waterproof state.

As described above, according to the aspect of the present invention as claimed in claim 1, when the covered wires are inserted into the wire insertion holes of the elastic waterproof portion, the projecting portions of the covered wires simply are required to be adjusted to have a predetermined length. Thus, the necessity of further locating the covered wires with respect to the solderless connectors can be eliminated when the solderless connection is established. Since the elastic waterproof portion is formed integrally with the case body, pressure cannot easily act on the portions in which the solderless terminals and the covered wires are solderless-connected to one another even if the elastic waterproof portion is strongly pressed to the inside of the opened portion after the covered wires have been solderless-connected to the solderless terminals.

Therefore, the electrically conductive state between the solderless terminals and the covered wires can be maintained.

Therefore, the solderless connector can easily be assembled so that the productivity is improved and the cost is reduced.

Other objects, features and advantages of the invention will be evident from the following detailed description of the preferred embodiments described in conjunction with the attached drawings.

DETAILED DESCRIPTION OF PREFERRED EMBODIMENTS

Preferred embodiments of the present invention will now be described with reference to the drawings.

Figure 1:
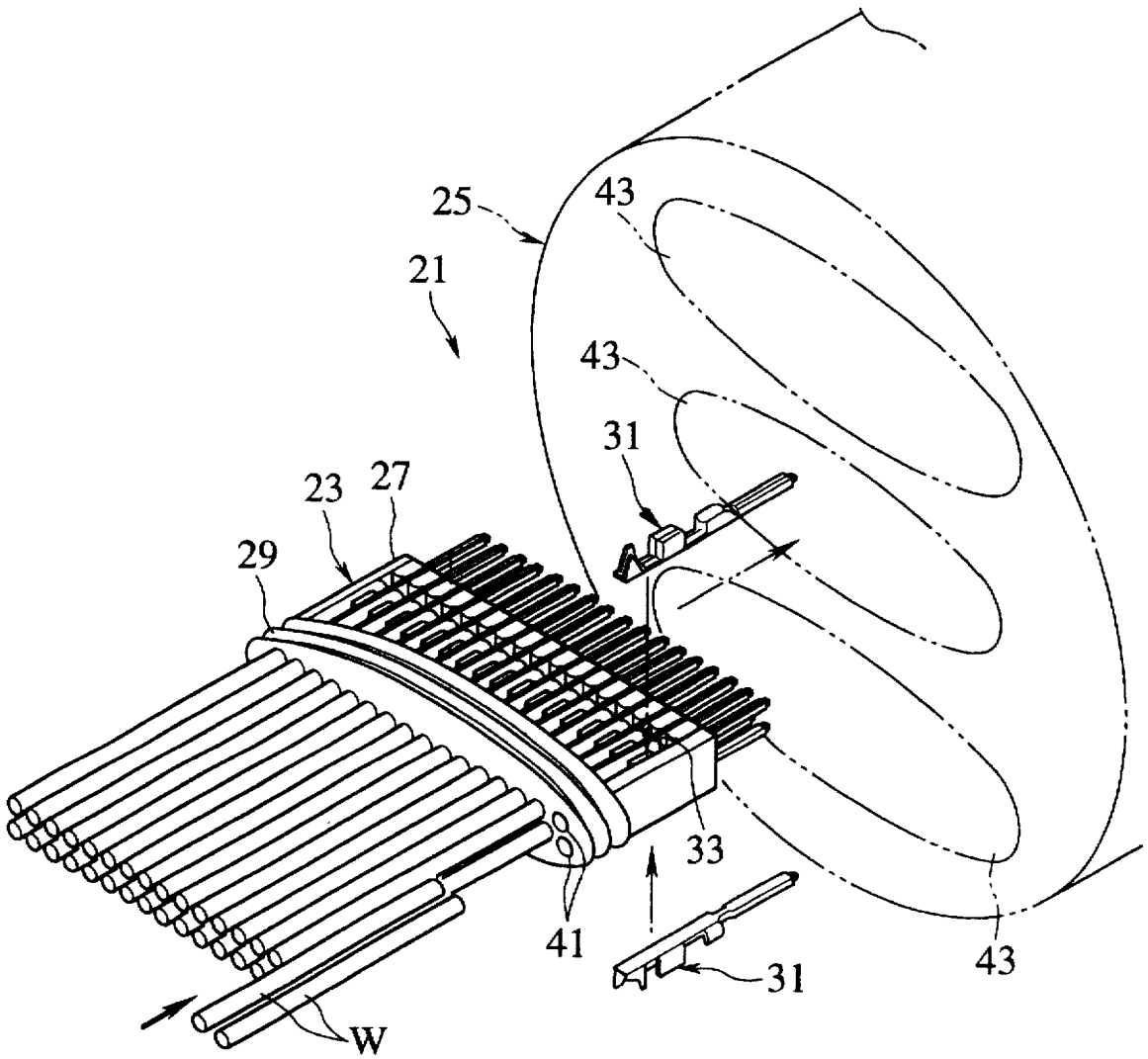
FIG. 1 is an exploded perspective view showing a waterproof structure of a solderless connector according to an embodiment of the present invention.

A solderless connector 21 shown in FIG. 1 is a male connector having a case 23 and a connector housing 25. The case 23 is composed of a case body 27 made of a hard resin and an elastic waterproofing portion 29 made of rubber.

Figure 2:
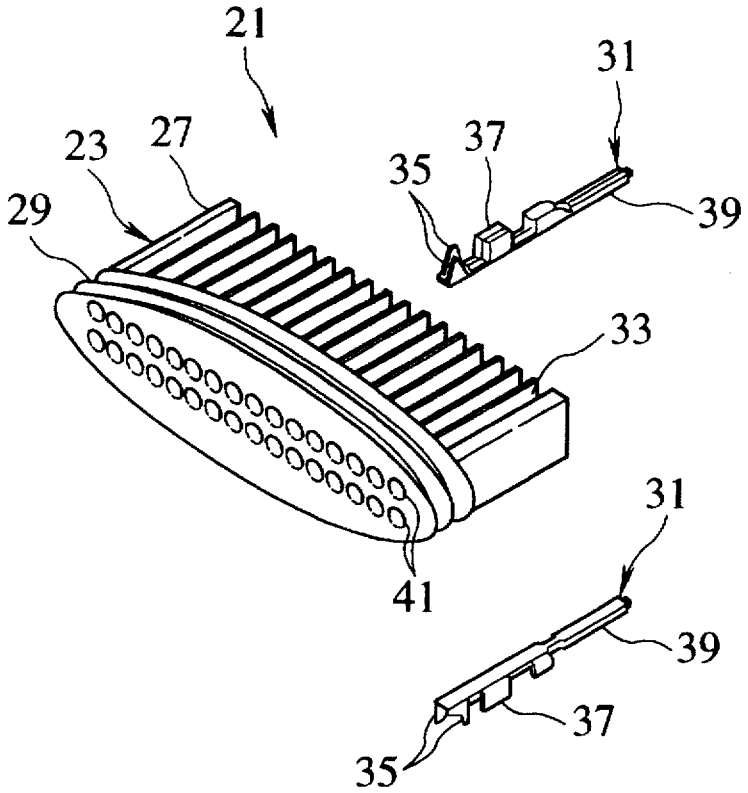
FIG. 2 is a perspective view showing a case and solderless terminals.
Figure 3:
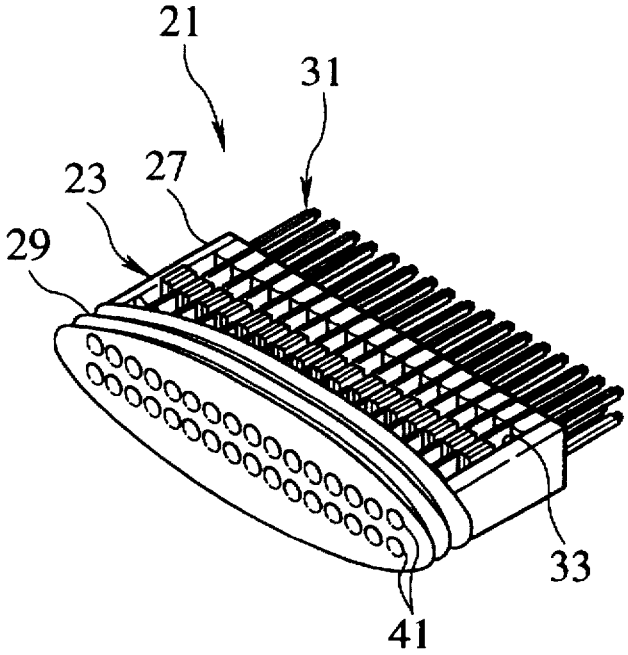
FIG. 3 is a perspective view showing a state where the solderless terminals are accommodated in the case.

As shown in FIGS. 2 and 3, the case body 27 has a plurality of terminal accommodating chambers 33 for accommodating a plurality of solderless terminals 31, the terminal accommodating chambers 33 being formed in parallel. The solderless terminals 31 are male terminals each having a caulking members 35 for caulking the covered portion of the covered wire W (see FIG. 1), a slot 37 to which the covered wire W is solderless-connected and a male connection portion 39 to be connected to a terminal intended to be connected.

Figure 4:
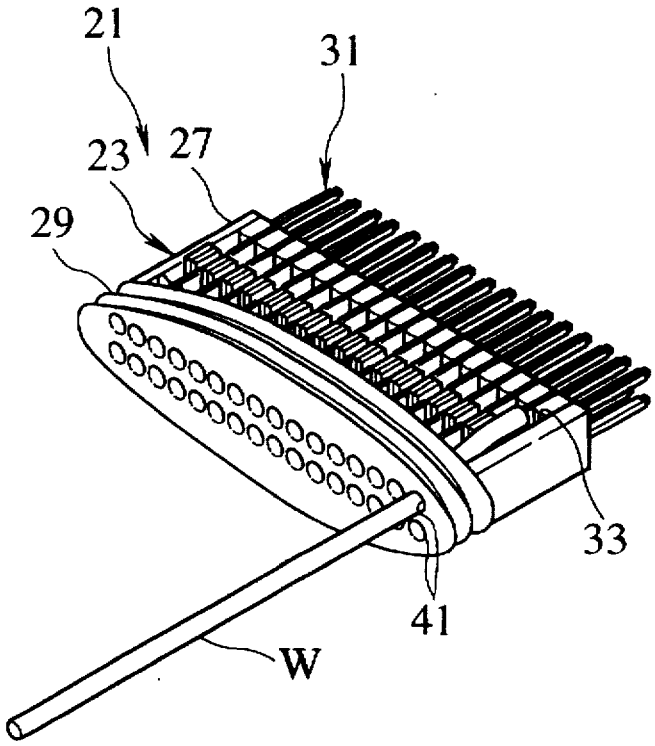
FIG. 4 is a perspective view showing a state where covered wires are inserted into wire insertion holes of an elastic waterproof portion.
Figure 5:
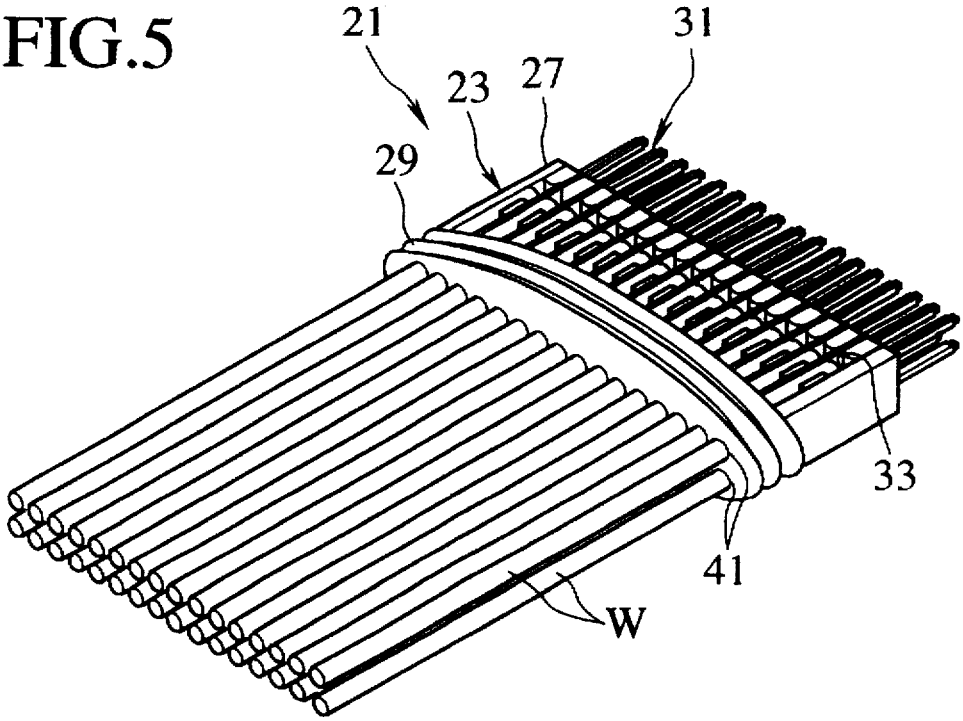
FIG. 5 is a perspective view showing a state where the covered wires are solderless-connected to the solderless terminals.

The elastic waterproofing portion 29 having an elliptical disc shape is integrally formed at an end of the case body 27. The elastic waterproofing portion 29 is integrally formed with the case body 27 by, for example, a method in which the case body 27 is formed by injection molding and then the case body 27 is loaded into a mold so as to injection-mold the elastic waterproofing portion 29; or a method in which the case body 27 and the elastic waterproofing portion 29 are molded individually and then they are bonded to each other. As shown in FIGS. 4 and 5, the elastic waterproofing portion 29 has a plurality of wire insertion holes 41 into which the covered wires W are inserted in a waterproof state, the wire insertion holes 41 forming two horizontal lines apart vertically. Each of the wire insertion holes 41 is formed at an end of each of the terminal accommodating chambers 33 to have substantially the same height as that of the terminal accommodating chambers 33. Thus, the covered wires W allowed to pass through the wire insertion holes 41 are bent upwards or downwards to be placed on the solderless terminals 31 (see FIG. 4), and then solderless-connected to the solderless terminals 31 (see FIG. 5).

Figure 6:
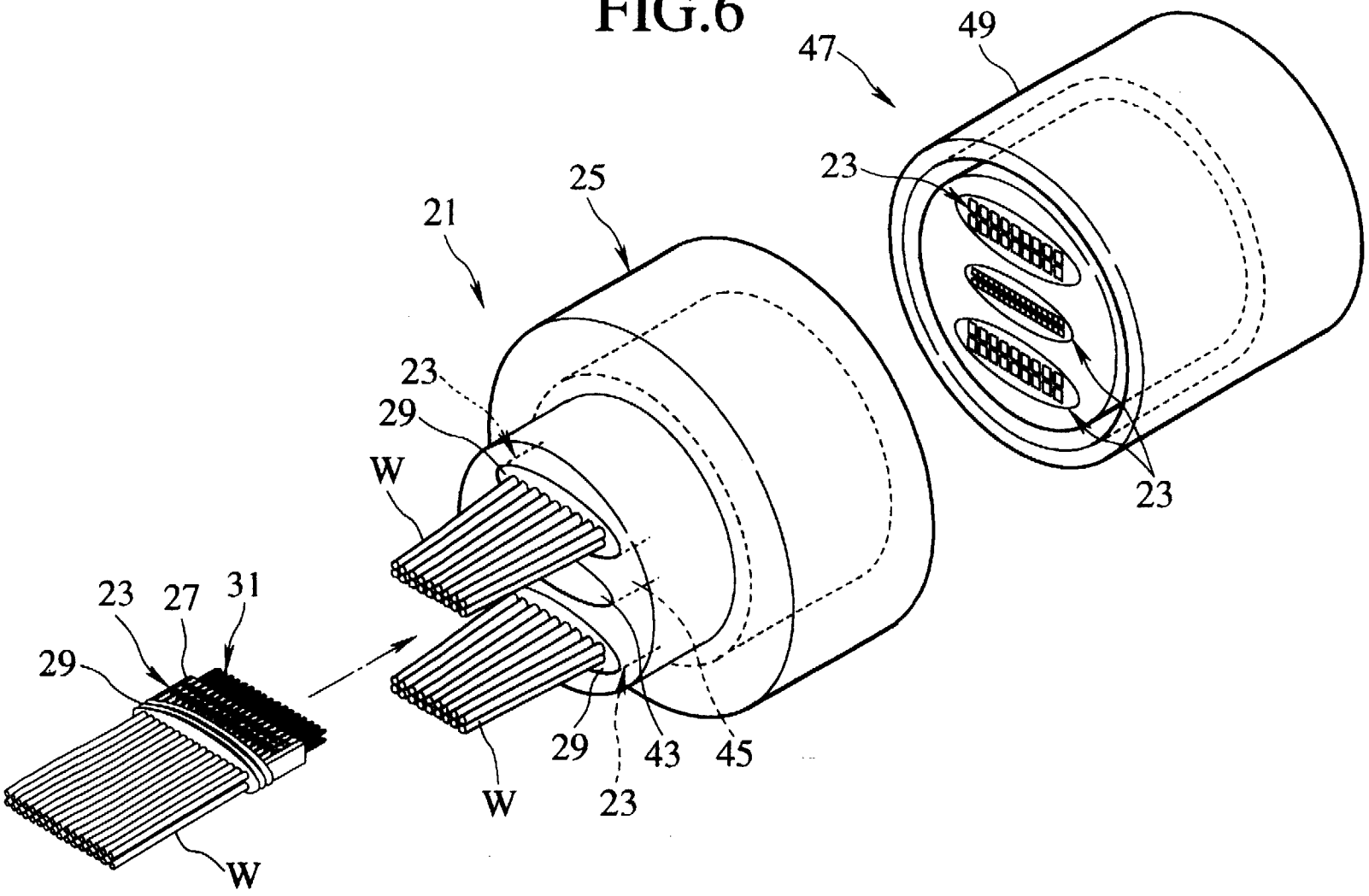
FIG. 6 is a perspective view showing the case and a connector housing.

As shown in FIG. 6, the male connector housing 25 has a case accommodation portion 45 at an end thereof, the case accommodation portion 45 having opened portions 43. The opened portions 43 are formed into an elliptical shape so that the periphery of the elastic waterproofing portion 29 is fitted in the waterproof state. Another end of the case 23, from which the male connection portions 39 of the solderless terminals 31 project, is inserted into the opened portion 43 so that the case body 27 is accommodated in the case accommodation portion 45. Moreover, the periphery of the elastic waterproofing portion 29 is fitted to the opened portion 43 in the waterproof state.

The male solderless connector 21 is connected to a female solderless connector 47 so as to be electrically conducted.

Figure 7:
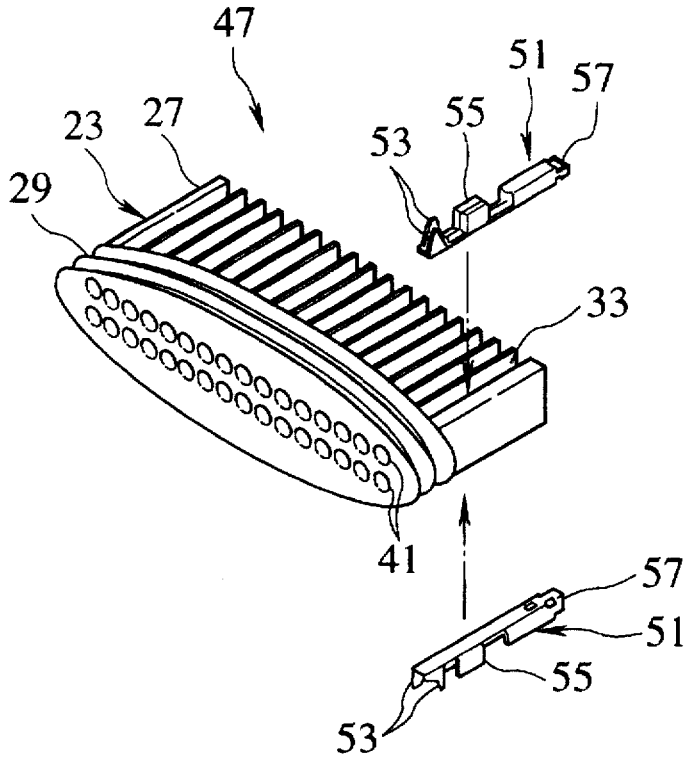
FIG. 7 is a perspective view showing a case and female solderless terminals to be accommodated in a connector housing of a female solderless connector.
Figure 8:
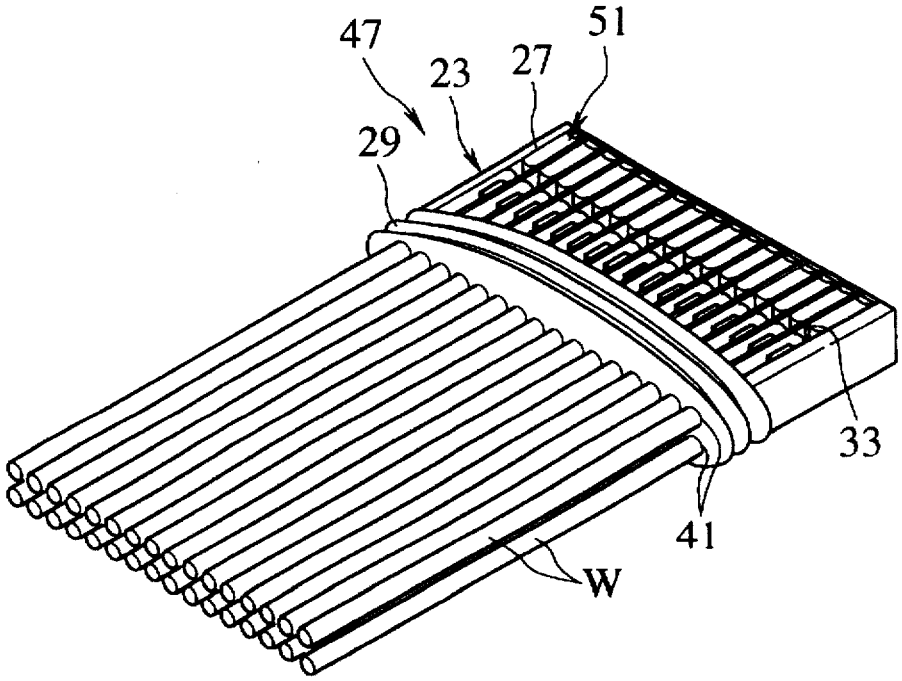
FIG. 8 is a perspective view showing a state where the covered wires are solderless-connected to female solderless terminals.

FIGS. 7 and 8 are perspective views showing a case and a male solderless connector to be accommodated in a connector housing for a female solderless connector. As shown in FIGS. 7 and 8, a female solderless connector 47 comprises a case 23 having a shape similar to that of the male solderless connector. A terminal accommodating chambers 33 of the case 23 accommodate a female solderless terminals 51 in place of the male solderless terminals 31. The female solderless terminals 51 have caulking members 53 for caulking the coated portions of each covered wire W, a slot 55 to which the covered wire W is solderless-connected and a female connection portion 57 into which the male connection portion 39 of each male solderless terminal 31 is inserted and connected. The covered wires W allowed to pass through the wire insertion holes 41 are, similarly to the state shown in FIG. 4, bent upwards or downwards so as to be placed on the female solderless terminals 51, and then solderless-connected to the female solderless terminals 51 (see FIG. 8).

A structure may be employed in which the wire insertion holes 41 and the terminal accommodating chambers 33 are not formed at the same height and the wire insertion holes 41 are made higher or lower than the terminal accommodating chambers 33, as shown in FIGS. 9 to 12. Since the necessity of bending the covered wires W, allowed to pass through the wire insertion holes 41, can be eliminated in this case, the covered wires W can be disposed straight (see FIG. 11). Therefore, the operation for inserting the covered wires W can easily be performed. The foregoing fact applies to the male solderless connector 21 shown in FIGS. 1 to 5.

The operation of the present invention will now be described.

FIGS. 9 to 12 are cross sectional views schematically showing the process for assembling the female solderless connector 47.

Figure 9:
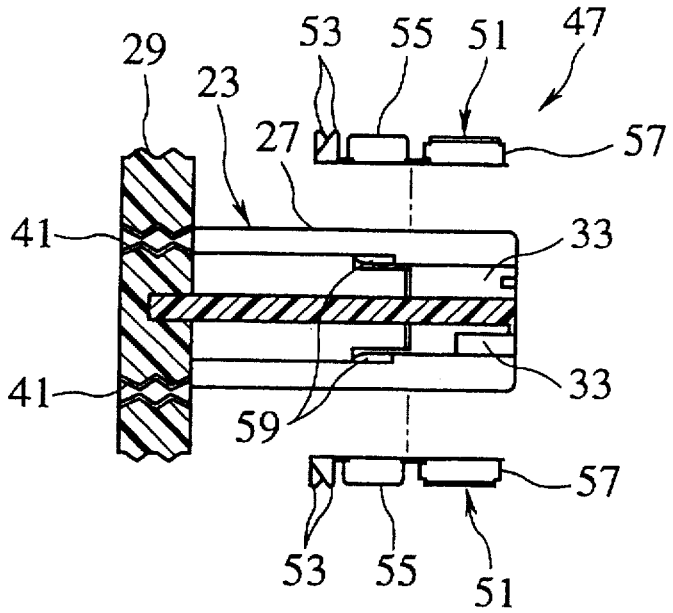
FIG. 9 is a cross sectional view schematically showing a process for assembling the female solderless connector.
Figure 10:
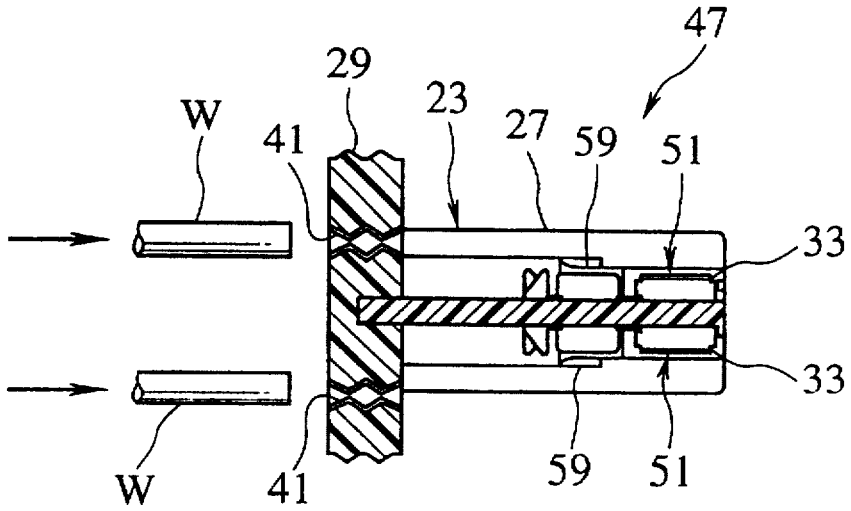
FIG. 10 is a cross sectional view schematically showing a process for assembling the female solderless connector.

When the female solderless connector 47 is assembled, the female solderless terminals 51 are, from the upper and lower positions, accommodated in the terminal accommodating chambers 33 of the case body 27, as shown in FIG. 9. The accommodated female solderless terminals 51 are engaged with terminal engagement portions 59 formed in the case body 27 as shown in FIG. 10 so that separation from the terminal accommodating chambers 33 is prevented.

Figure 11:
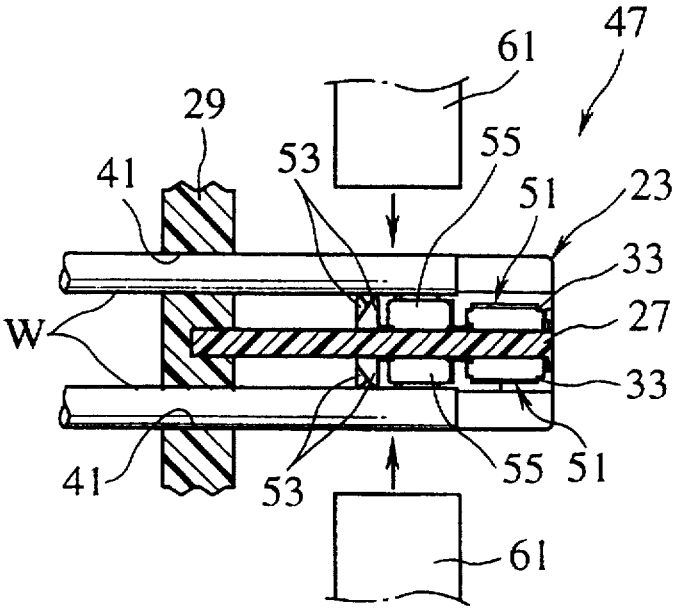
FIG. 11 is a cross sectional view schematically showing a process for assembling the female solderless connector.

Then, the covered wires W are inserted into the wire insertion holes 41 of the elastic waterproofing portion 29 and the leading ends of the covered wires W are positioned above and lower the caulking members 53 and the slot 55 of the female solderless terminals 51, as shown in FIG. 11. As a result, the covered wires W penetrate the wire insertion holes 41 in the waterproof state.

Figure 12:
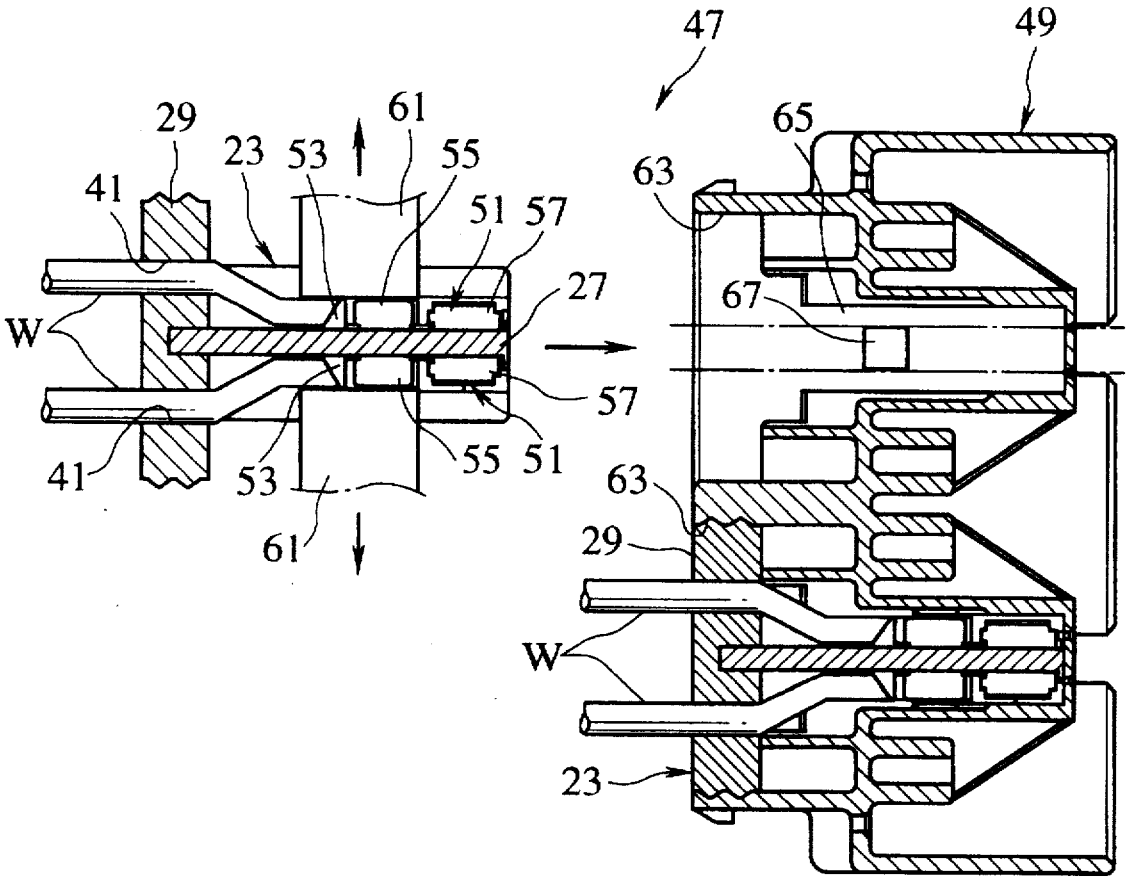
FIG. 12 is a cross sectional view schematically showing a process for assembling the female solderless connector.

Then, as shown in FIG. 12, the covered wires W, which have penetrated the wire insertion holes 41, are pressed from the upper and lower positions by a solderless caulking jig 61 so that the caulking members 53 are caulked and the female solderless terminals 51 are mechanically secured to the covered wires W. Moreover, the covered wires W are solderless-connected to the slots 55 so that they are electrically conducted.

Then, the case 23 is inserted into the opened portion 63 of the connector housing 49 from the other side from which the female connection portions 57 of the female solderless terminals 51 are exposed to the outside so that the case body 27 is accommodated in the case accommodation portion 65. Moreover, the periphery of the elastic waterproofing portion 29 is fitted to the opened portion 63 in the waterproof state. The accommodated case body 27 is engaged to a case engagement portion 67 formed in the connector housing 49 so that separation from the case accommodation portion 65 is prevented. As a result, the female solderless connector 47 is assembled. Since the space between the covered wire W and the wire insertion hole 41 and that between the opened portion 63 and the elastic waterproofing portion 29 are waterproofed in the above-mentioned state, the main portion of the connector including the portions in which the solderless terminals 51 and the covered wires W are solderless-connected to one another is satisfactorily waterproofed.

As described above, according to this embodiment, when the covered wires W are inserted into the wire insertion holes 41 of the elastic waterproofing portion 29, the length of projection of the covered wires W is adjusted to a predetermined length. Moreover, the leading ends of the covered wires W are positioned higher or lower than the caulking members 53 and the slot 55 of the solderless terminals 51. As a result, the leading ends of the covered wires W are maintained at predetermined positions by the wire insertion holes 41. Therefore, the necessity of furthermore locating the covered wires W with respect to the solderless terminals 51 can be eliminated when the solderless connection is established.

As described above, the elastic waterproofing portion 29 is formed integrally with the case body 27. Therefore, even if the elastic waterproofing portion 29 is strongly pressed to the inside of the opened portion 63 to fit the elastic waterproofing portion 29 to the opened portion 63 of the connector housing 49 after the covered wires W have been solderless connected to the female solderless terminals 51, the pressure does not easily act on the portions in which the solderless terminals 51 and the covered wires W are solderless-connected to one another. Thus, the electrically conductive state between the female solderless terminals 51 and the covered wires W can be maintained.

Therefore, the operation for assembling the female solderless connector 47 can easily be performed so that the productivity is improved and the cost is reduced.

Note that the male solderless connector 21 can be assembled by a process similar to that for assembling the female solderless connector and similar advantage can be obtained. Although the invention has been described in its referred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. A waterproof solderless connector assembly comprising:

a case body including a plurality of terminal accommodating chambers which accommodate a plurality of solderless terminals, to which solderless covered wires are solderless-connected, and which are formed in parallel, said case body being formed by injection molding and further including a distal end having an elastic waterproof flange portion projecting therefrom and formed integrally by injection molding on said case body to define a unitary construction, said waterproof flange portion having a plurality of wire insertion holes defined therethrough through which the covered wires are inserted in a waterproof state to the terminal accommodating chambers;

wherein another end of said case body is inserted through an opened portion of a connector housing so that the case body is accommodated in the connector housing, and the periphery of said elastic waterproof flange portion is fitted to the open portion of said connector housing in a waterproof state.

2. A waterproof structure of a solderless connector as claimed in claim 1, wherein said case body is made of hard resin and said elastic waterproof flange portion is made of rubber.

3. A waterproof solderless connector assembly as claimed in claim 1, further comprising positioning means for positioning the covered wires such that, upon insertion of the covered wires through said wire insertion holes respectively, the covered wires are positioned on said terminal accommodating chambers of said case body, respectively.

4. A waterproof solderless connector assembly as claimed in claim 3, wherein said positioning means comprises caulking members formed on said solderless terminals, for caulking covered portions of the covered wires.

5. A waterproof solderless connector assembly as claimed in claim 3, wherein said positioning means comprises said wire insertion holes of said waterproof flange portion, each of which is offset from a corresponding terminal accommodating chamber.

* * * * *